US006966300B2

(12) United States Patent
Fukuda

(10) Patent No.: US 6,966,300 B2
(45) Date of Patent: Nov. 22, 2005

(54) VALVE OPENING DEGREE CONTROL SYSTEM AND COMMON RAIL TYPE FUEL INJECTION SYSTEM

(75) Inventor: Yushi Fukuda, Chiryu (JP)

(73) Assignee: Denso Corporation, Kariya (JP)

( * ) Notice: Subject to any disclaimer, the term of this patent is extended or adjusted under 35 U.S.C. 154(b) by 40 days.

(21) Appl. No.: 10/974,757

(22) Filed: Oct. 28, 2004

(65) Prior Publication Data

US 2005/0092301 A1 May 5, 2005

(30) Foreign Application Priority Data

Nov. 4, 2003 (JP) ..... 2003-374733

(51) Int. Cl.[7] ..... F02D 41/38

(52) U.S. Cl. ..... 123/446; 123/456; 123/357; 123/514; 137/487.5; 700/47; 700/282; 701/103; 701/104

(58) Field of Search ..... 123/446, 447, 123/456, 514, 357, 457, 459; 137/487.5; 700/47, 282; 701/103, 104

(56) References Cited

U.S. PATENT DOCUMENTS 4,773,370 A * 9/1988 Koshizawa et al. ..... 123/357
5,483,940 A * 1/1996 Namba et al. ..... 123/497
6,101,456 A * 8/2000 Kowatari et al. ..... 702/105
6,539,921 B1 * 4/2003 Matsumura ..... 123/456
2001/0027775 A1 * 10/2001 Sakai et al. ..... 123/457

FOREIGN PATENT DOCUMENTS

JP A-2001-82230 3/2001

* cited by examiner

*Primary Examiner*—Weilun Lo
(74) *Attorney, Agent, or Firm*—Nixon & Vanderhye P.C.

(57) ABSTRACT

When a learning condition is satisfied, control device performs a feedback control. In the feedback control, a metering valve control value is progressively increased to progressively increase a degree of opening of an inlet metering valve, and a pressure of a common rail is kept constant. When the amount of change in a pressure-reducing valve control value becomes equal to or less than a predetermined value, a current metering valve control value, which is currently supplied to the inlet metering valve, is obtained as a maximum discharge rate control value. Also, an intake initiation control value, at which a high pressure pump begins intake of fuel, is obtained. Then, based on these values, a pump characteristic is obtained. Thereafter, the control device obtains the metering valve control value based on a computed degree of opening of the inlet metering valve and the pump characteristic.

9 Claims, 7 Drawing Sheets

VALVE OPENING DEGREE CONTROL SYSTEM AND COMMON RAIL TYPE FUEL INJECTION SYSTEM

CROSS REFERENCE TO RELATED APPLICATION

This application is based on and incorporates herein by reference Japanese Patent Application No. 2003-374733 filed on Nov. 4, 2003.

BACKGROUND OF THE INVENTION

1. Field of the Invention

The present invention relates to a valve opening degree control system and a common rail type fuel injection system.

2. Description of Related Art

A common rail type fuel injection system controls a rail pressure (a pressure of fuel accumulated in a common rail) by controlling a discharge rate of a high pressure pump to limit a reduction in the rail pressure caused by fuel injection or to increase the rail pressure according to an operational state. The discharge rate of the high pressure pump is controlled by adjusting or controlling an intake rate of fuel, which is drawn into a compression chamber of the high pressure pump, through use of an inlet metering valve.

More specifically, the common rail type fuel injection system controls the rail pressure by controlling the discharge rate of the high pressure pump through adjustment of a degree of opening of the inlet metering valve by a control device.

Thus, the discharge rate of the high pressure pump relative to a metering valve control value (a drive electric current value for achieving a predetermined degree of opening of the inlet metering valve), which is supplied to the inlet metering valve, should coincides with a predetermined pump characteristic.

However, the actual discharge rate of fuel, which is actually discharged from the high pressure pump, can possibly vary relative to the metering valve control value due to various factors, such as manufacturing variations and aging variations of the mass produced inlet metering valves, and/or variations in the temperature characteristics of, for example, a fuel viscosity or a coil attractive force.

To address the above disadvantages, for example, Japanese Unexamined Patent Publication No. 2001-82230 proposes the following learning control operation. In this learning control operation, when a predetermined learning condition is satisfied (e.g., when an engine is in an idling state), the degree of opening of the inlet metering valve is progressively increased from a prefixed value, at which a zero intake rate of the inlet metering valve is guaranteed. At the time of progressively increasing the degree of opening of the inlet metering valve from this value, when the amount of the change in the rail pressure becomes equal to or greater than a predetermined value, the current metering valve control value, which is currently supplied to the inlet metering valve, is obtained as an intake initiation control value. Then, this value (the intake initiation control value) is learned as a metering valve control value, at which the high pressure pump begins the intake of fuel. In this way, variations in the small discharge rate range of the high pressure pump (the small degree of opening of the inlet metering valve) are corrected.

When an opening cross sectional area variable valve, which varies its fuel passage opening cross sectional area, is used as a valve (corresponding to the inlet metering valve in the above case), accurate control of the passage opening cross sectional area of the valve between a small degree of opening and a large degree of opening is required. However, when the above technique recited in Japanese Unexamined Patent Publication No. 2001-82230 is applied to the learning control of the valve, the variation in the small degree of opening of the valve can be corrected, and the variation in the large degree of opening of the valve cannot be corrected.

Furthermore, when the opening cross sectional area variable valve is not used as the above valve, that is when a valve, which adjusts the degree of opening of the valve by adjusting a time period of opening (i.e., fully opening) the valve, is used, the variation is correctable only in the small degree of opening of the valve while disallowing correction of the variation in the large degree of opening of the valve.

For example, when the opening cross sectional area variable valve, which adjusts the passage opening cross sectional area of a fluid passage that conducts the fluid to the high pressure pump, is used as the inlet metering valve of the common rail type fuel injection system, accurate control of the opening cross sectional area of the fluid passage between the small degree of opening and the large degree of opening is required. However, the above technique recited in Japanese Unexamined Patent Publication No. 2001-82230 is intended to correct the variation in the small degree of opening of the inlet metering valve (a small discharge rate range of the high pressure pump) and cannot correct the variation in the large degree of opening of the inlet metering valve (a large discharge rate range of the high pressure pump).

Furthermore, when the opening cross sectional area variable valve is not used as the inlet metering valve, that is, when the valve, which adjusts the degree of opening of the valve by adjusting the time period of opening (i.e., fully opening) the valve, is used as the inlet metering valve, the variation is only correctable in the small degree of opening, and the variation in the large degree of opening is not correctable.

In some common rail type fuel injection systems, a pressure-reducing valve, which reduces the rail pressure by draining the fuel accumulated in the common rail, is provided.

When a predetermined condition for rapidly reducing the rail pressure, is satisfied due to a change in the operational state, a required degree of opening of the pressure-reducing valve, which corresponds to the required pressure to be decreased, is computed by the control device. Then, a pressure-reducing valve control value, which corresponds to the required degree of opening, is supplied to the pressure-reducing valve. Thus, the rail pressure is rapidly reduced to the target rail pressure by the pressure-reducing valve.

For example, when the opening cross sectional area variable valve, which adjusts the passage opening cross sectional area of a drain passage that drains the fluid accumulated in the common rail, is used as the pressure-reducing valve, accurate control of the opening cross sectional area of the drain passage between the small degree of opening and the large degree of opening is required. However, when the above technique recited in Japanese Unexamined Patent Publication No. 2001-82230 is used in the correcting operation of the pressure-reducing valve, the variation in the small degree of opening of the pressure-reducing valve can be corrected, and the variation in the large degree of opening of the pressure-reducing valve cannot be corrected.

Furthermore, when the opening cross sectional area variable valve is not used as the pressure-reducing valve, that is, when the valve, which adjusts the degree of opening of the valve by adjusting the time period of opening (i.e., fully opening) the valve, is used as the pressure-reducing valve, the variation is only correctable in the small degree of opening, and the variation in the large degree of opening is not correctable.

SUMMARY OF THE INVENTION

The present invention addresses the above disadvantages. Thus, it is a first objective of the present invention to provide a valve opening degree control system, which is capable of correcting a variation in a large degree of opening of a valve. It is a second objective of the present invention to provided a common rail type fuel injection system, which is capable of correcting a variation in a large degree of opening of an inlet metering valve (in a large discharge rate range of a high pressure pump). Furthermore, it is a third objective of the present invention to provided a common rail type fuel injection system, which is capable of correcting a variation in a large degree of opening of a pressure-reducing valve (in a range, at which the rail pressure is rapidly reduced).

To achieve the objectives of the present invention, there is provided a valve opening degree control system. The valve opening degree control system includes a fluid drive means, a valve, a control device and a flow rate change sensing means. The fluid drive means is for drawing or pumping fluid. The valve adjusts a degree of opening of a fluid passage, which conducts the fluid drawn or pumped by the fluid drive means. A maximum adjusting performance of the valve is larger than a maximum performance of the fluid drive means. The control device controls a degree of opening of the valve. The flow rate change sensing means is for sensing an amount of change in the flow rate of the fluid, which is conducted through the fluid passage. The control device includes a learning means. The learning means controls a valve control value, which is supplied to the valve to control the degree of opening of the valve. The learning means controls the valve control value in a manner that achieves one of: progressively increasing of the degree of opening of the valve from a first preset value, which is smaller than a maximum performance implementing threshold value that implements the maximum performance of the fluid drive means; and progressively reducing of the degree of opening of the valve from a second preset value, which is larger than the maximum performance implementing threshold value that implements the maximum performance of the fluid drive means. At the time of progressively increasing the degree of opening of the valve from the first preset value, when the amount of change in the flow rate of the fluid in the fluid passage, which is sensed by the flow rate change sensing means, becomes equal to or less than a corresponding predetermined value, the learning means obtains the current valve control value, which is currently supplied to the valve, as a maximum control value. At the time of progressively decreasing the degree of opening of the valve from the second preset value, when the amount of change in the flow rate of the fluid in the fluid passage, which is sensed by the flow rate change sensing means, becomes equal to or greater than a corresponding predetermined value, the learning means obtains the current valve control value, which is currently supplied to the valve, as the maximum control value. The learning means learns that the fluid drive means attains the maximum performance at the maximum control value.

To achieve the objectives of the present invention, there is also provided a common rail type fuel injection system. The common rail type fuel injection system includes a common rail, an injector, a high pressure pump, an inlet metering valve, a control device and a discharge rate sensing means. The common rail accumulates high pressure fuel. The injector injects the high pressure fuel accumulated in the common rail. The high pressure pump includes a compression chamber, which draws and pressurizes fuel. The high pressure pump feeds the pressurized fuel to the common rail. The inlet metering valve adjusts a degree of opening of a feed passage, which conducts fuel to the high pressure pump, to adjust a discharge rate of the high pressure pump. A maximum feed rate of fuel, which is fed from the inlet metering valve to the high pressure pump, is greater than a maximum discharge rate of the high pressure pump. The control device controls at least a degree of opening of the inlet metering valve. The discharge rate change sensing means is for sensing an amount of change in the discharge rate of the high pressure pump. The control device includes a learning means. The learning means controls a metering valve control value, which is supplied to the inlet metering valve to control the degree of opening of the inlet metering valve. The learning means controls the metering valve control value in a manner that progressively increases the degree of opening of the inlet metering valve from a preset value, which is smaller than a maximum discharge rate implementing threshold value that implements the maximum discharge rate of the high pressure pump. At the time of progressively increasing the degree of opening of the inlet metering valve, when the amount of change in the discharge rate of the high pressure pump, which is sensed by the discharge rate change sensing means, becomes equal to or less than a predetermined value, the learning means obtains the current metering valve control value, which is currently supplied to the inlet metering valve, as a maximum discharge rate control value. The learning means learns that the high pressure pump attains the maximum discharge rate at the maximum discharge rate control value.

To achieve the objectives of the present invention, there is also provided a common rail type fuel injection system. The common rail type fuel injection system includes a common rail, an injector, a high pressure pump, an inlet metering valve, a pressure-reducing valve, a control device and a feed rate change sensing means. The common rail accumulates high pressure fuel. The injector injects the high pressure fuel accumulated in the common rail. The high pressure pump includes a compression chamber, which draws and pressurizes fuel. The high pressure pump feeds the pressurized fuel to the common rail. The inlet metering valve adjusts a degree of opening of a feed passage, which conducts fuel to the high pressure pump. The pressure-reducing valve adjusts a degree of opening of a drain passage, through which the fuel accumulated in the common rail is drained. A maximum draining rate of the pressure-reducing valve for draining the fuel accumulated in the common rail is greater than a maximum feed rate of fuel, which is fed from the high pressure pump to the common rail. The control device controls at least a degree of opening of the inlet metering valve and a degree of opening of the pressure-reducing valve. The feed rate change sensing means is for sensing an amount of change in the feed rate of fuel, which is fed from the high pressure pump to the common rail. The control device includes a learning means. The learning means controls a pressure-reducing valve control value, which is supplied to the pressure-reducing valve to control the degree of opening of the pressure-reducing valve. The learning means controls the pressure-reducing valve control value in a manner that progressively increases the degree of opening of the pressure-reducing valve from a preset value, which is smaller than a maximum feed rate implementing threshold value that implements the maximum feed rate of the fuel, which is fed from the high pressure pump to the common rail. The learning means also controls a metering valve control value, which is supplied to the inlet metering valve to control the degree of opening of the inlet metering valve. The learning means controls the metering valve control value in a manner that maintains a constant pressure in the common rail at the time of controlling the pressure-reducing valve control value. At the time of progressively increasing the degree of opening of the pressure-reducing valve, when the amount of change in the feed rate of the fuel, which is fed from the high pressure pump to the common rail, becomes equal to or less than a predetermined value, the learning means obtains the current pressure-reducing valve control value, which is currently supplied to the pressure-reducing valve, as a maximum draining rate control value. The learning means learns that the pressure-reducing valve attains the maximum draining rate at the maximum draining rate control value.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

A first embodiment of the present invention will be described with reference to FIGS. 1 to 6.

Figure 1:
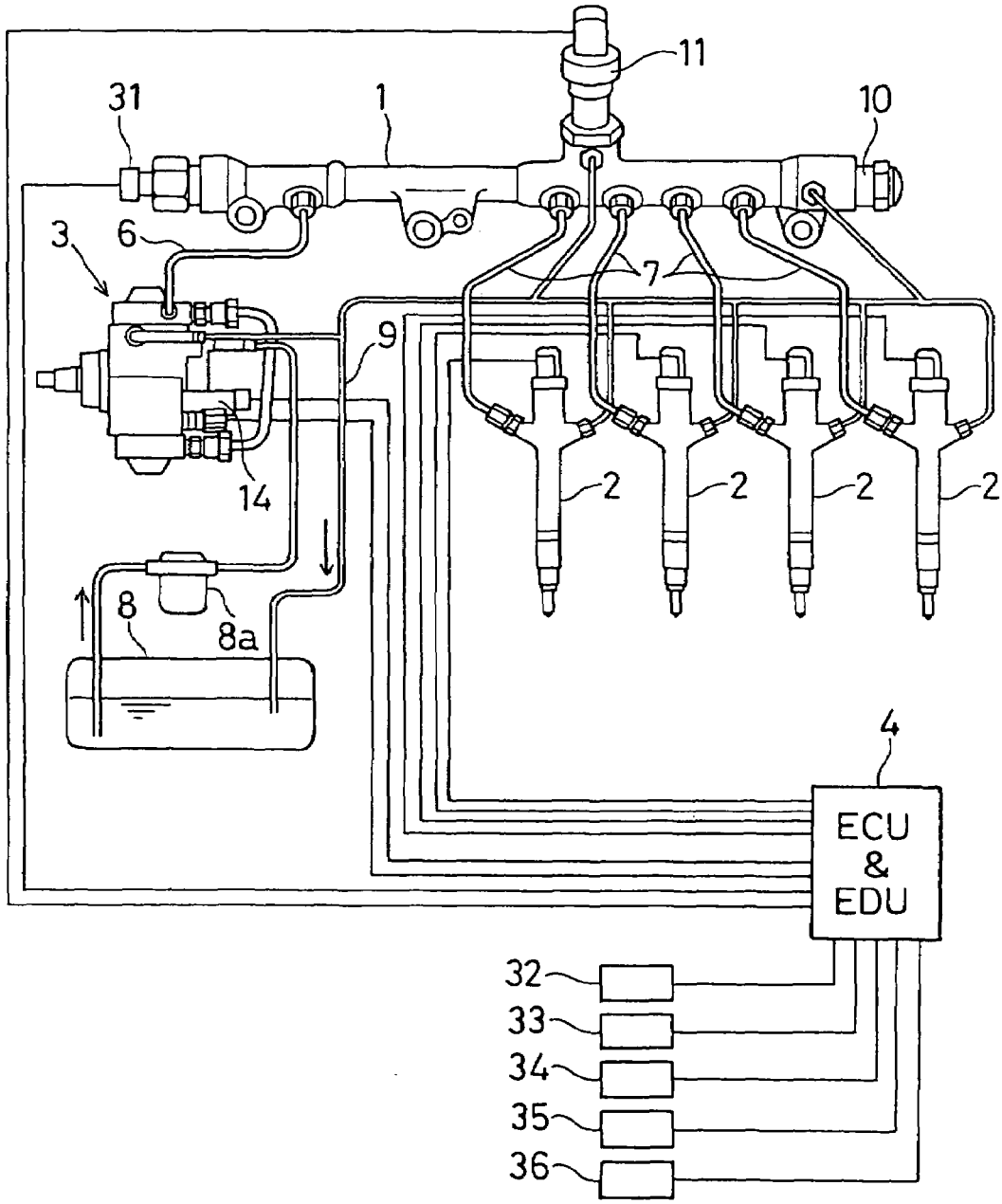
FIG. 1 is a schematic descriptive view of a common rail type fuel injection system according to a first embodiment of the present invention.

As shown in FIG. 1, a common rail type fuel injection system according to the first embodiment is a system, which injects fuel in a four cylinder engine (e.g., a four cylinder diesel engine) and includes a common rail 1, injectors 2, a supply pump 3 and a control device 4. The control device 4 includes an ECU (engine control unit) and an EDU (driving unit). Although FIG. 1 depicts the single control device 4, which integrally includes both the ECU and the EDU, the ECU and the EDU may be provided separately, if desired.

The common rail 1 is a pressure accumulator, which accumulates high pressure fuel to be supplied to the injectors 2. The common rail 1 is connected to an outlet of the supply pump 3 through a pump pipeline (high pressure fuel passage) 6 and is also connected to injector pipelines 7 in a manner that allows continuous accumulation of a rail pressure, which corresponds to a fuel injection pressure of the injector 2, in the common rail 1. The supply pump 3 discharges high pressure fuel to the common rail 1 through its outlet. The injector pipelines 7 supply the high pressure fuel from the common rail 1 to the injectors 2.

A relief pipeline 9 returns fuel from the common rail 1 to a fuel tank 8, and a pressure limiter 10 is installed in the relief pipeline 9. The pressure limiter 10 is a relief valve, which opens when a fuel pressure in the common rail 1 exceeds an upper threshold value to keep the fuel pressure of the common rail 1 equal to or less than the threshold value.

A pressure-reducing valve 11 is installed to the common rail 1. The pressure-reducing valve 11 adjusts a passage opening cross sectional area (a degree of opening) of a drain passage, which communicates between the common rail 1 and the relief pipeline 9 to drain the fuel accumulated in the common rail 1.

The pressure-reducing valve 11 is provided to rapidly reduce the rail pressure through the relief pipeline 9. The control device 4 adjusts the degree of opening of the pressure-reducing valve 11 to rapidly reduce the rail pressure to a level that corresponds to the driving state of a vehicle.

The pressure-reducing valve 11 is of an opening cross sectional area variable type, which includes a valve part and a solenoid. The valve part changes the degree of opening (passage opening cross sectional area) in the drain passage, and the solenoid adjusts the degree of opening (a passage opening cross sectional area) of the valve part based on a pressure-reducing valve control value (a pressure-reducing valve drive electric current value) supplied from the control device 4 to the solenoid. The pressure-reducing valve 11 is of a normally closed type, in which the degree of opening of the valve becomes zero (i.e., a fully closed state) when the solenoid is deenergized.

Figure 3:
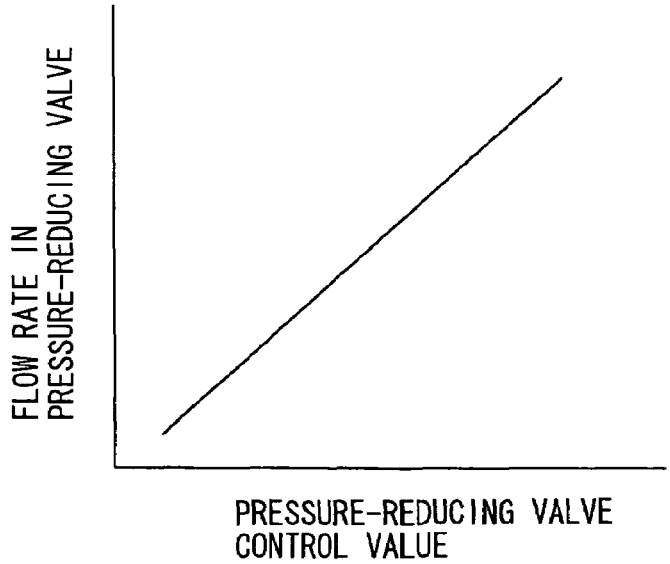
FIG. 3 is a graph showing a relationship between a flow rate of a pressure-reducing valve and a pressure-reducing valve control value according to the first embodiment.

A maximum draining rate of the pressure-reducing valve 11 for draining fuel accumulated in the common rail 1 is greater than a maximum discharge rate of the high pressure pump 15 (a maximum discharge rate of the supply pump 3, i.e., a maximum quantity of fuel discharged from the supply pump 3 per rotation of the supply pump 3). Furthermore, as shown in FIG. 3, when the pressure-reducing valve control value is gradually increased, the flow rate (a draining rate)

of the fuel through the pressure-reducing valve 11 is increased proportionally with the pressure-reducing valve control value.

Each injector 2 is provided to a corresponding one of the cylinders of the engine and injects fuel into the corresponding cylinder. The injector 2 is connected to a downstream end of the corresponding injector pipeline 7, which branches from the common rail 1. Furthermore, the injector 2 includes a fuel injection nozzle and a solenoid valve. The fuel injection nozzle injects high pressure fuel, which is accumulated in the common rail 1, to the corresponding cylinder. The solenoid valve performs lift control of a needle arranged in the fuel injection nozzle. Leaked fuel from the injector 2 is also returned to the fuel tank 8 through the relief pipeline 9.

Figure 2:
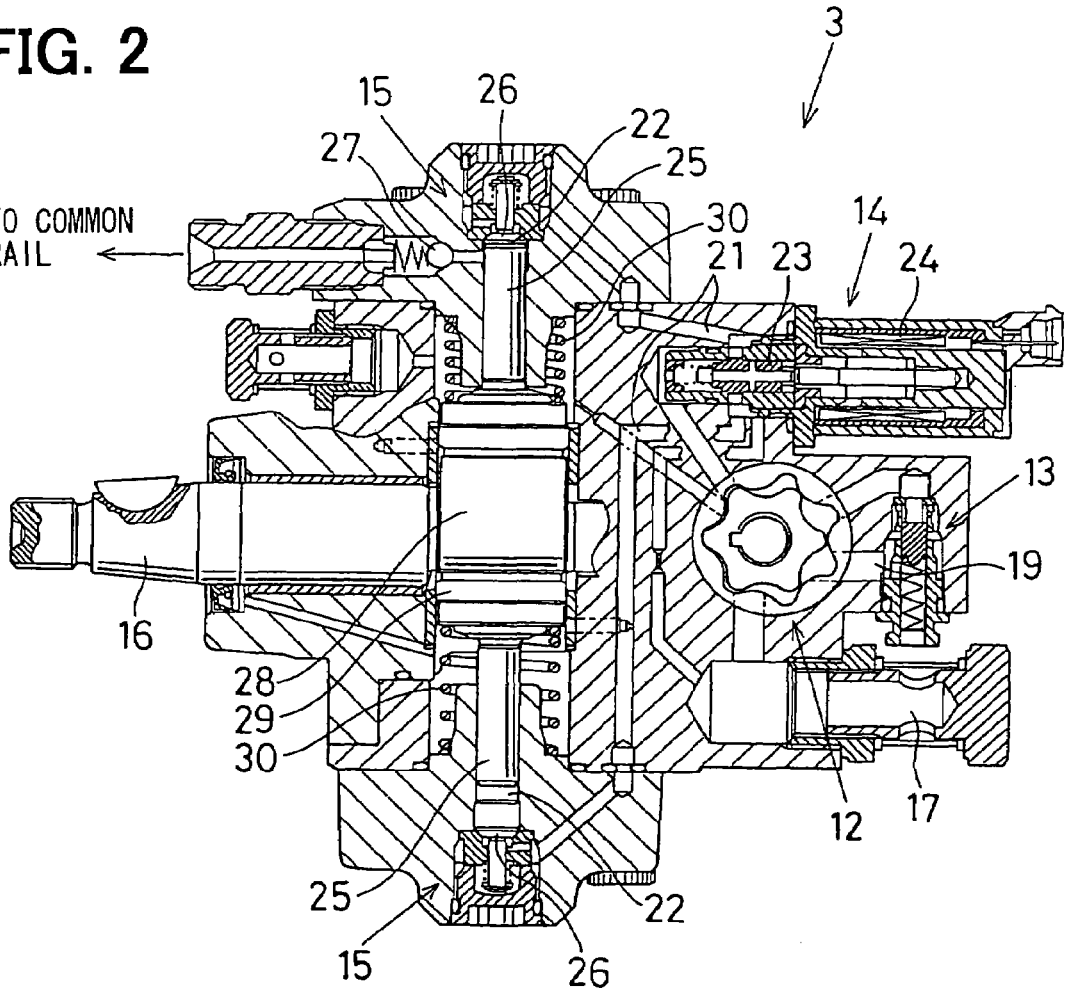
FIG. 2 is an enlarged schematic cross sectional view of a supply pump of the common rail type fuel injection system of the first embodiment.

The supply pump 3 will be described in greater detail with reference to FIG. 2.

The supply pump 3 is provided to supply high pressure fuel to the common rail 1. The supply pump 3 includes a feed pump 12, a regulator valve 13, an inlet metering valve 14 and a high pressure pump 15. It should be noted that the feed pump 12 is displaced 90 degrees from the actual position in FIG. 2 to show a structure of the feed pump 12.

The feed pump 12 is a low pressure feed pump, which draws fuel from the fuel tank 8 through a fuel filter 8*a* and discharges the drawn fuel toward the high pressure pump 15. The feed pump 12 is a trochoid pump, which is rotated by a cam shaft 16. When the feed pump 12 is driven, the feed pump 12 feeds the fuel, which is drawn through a fuel inlet 17, to the high pressure pump 15 through the inlet metering valve 14.

The cam shaft 16 is a pump drive shaft and is rotated by a crank shaft of the engine.

The regulator valve 13 is arranged in a fuel passage 19, which communicates between an outlet and the inlet of the feed pump 12. When a discharge pressure of the feed pump 12 is increased to a predetermined value, the regulator valve 13 is opened to prevent the discharge pressure of the feed pump 12 from exceeding the predetermined pressure.

The inlet metering valve 14 is arranged in a feed passage (a fluid passage) 21, which conducts the fuel from the feed pump 12 to the high pressure pump 15. The inlet metering valve 14 adjusts an intake quantity of fuel, which is drawn into a corresponding compression chamber (plunger chamber) 22 of the high pressure pump 15 to change and adjust the rail pressure.

The inlet metering valve 14 is of an opening cross sectional area variable type, which includes a valve part 23 and a linear solenoid 24. The valve part 23 changes a passage opening cross sectional area (a degree of opening) in the feed passage 21, which conducts the fuel from the feed pump 12 to the high pressure pump 15. The linear solenoid 24 adjusts the degree of opening (the passage opening cross sectional area) of the valve 23 according to an inlet metering valve control value supplied from the control device 4. The metering valve control value corresponds to an inlet metering valve drive electric current value supplied to the inlet metering valve 14 to achieve a computed target degree of opening of the inlet metering valve 14, which is computed in the control device 4 based on the operational state. In the first embodiment, the inlet metering valve 14 is of a normally closed type, in which the degree of opening becomes zero (i.e., a fully closed state) when the linear solenoid 24 is deenergized.

A maximum feed rate (a maximum adjusting performance of the inlet metering valve 14) of fuel, which is fed from the inlet metering valve 14 to the high pressure pump 15, is larger than the maximum discharge rate (a maximum performance) of the high pressure pump 15. More specifically, when the metering valve control value for controlling the inlet metering valve 14 is progressively increased, the discharge rate of the high pressure pump 15 reaches the maximum discharge rate of the high pressure pump 15 and thereafter becomes constant (i.e., showing no further change in the discharge rate of the high pressure pump 15).

The high pressure pump 15 is a plunger pump, which compresses the fuel supplied from the inlet metering valve 14 and which then feeds it to the common rail 1. The high pressure pump 15 includes plungers 25, inlet valves 26 and a delivery valve 27. The plunger 25 is reciprocated by the cam shaft 16. The inlet valve 26 supplies fuel to the corresponding compression chamber 22, which has a variable volume that changes upon reciprocal movement of the plunger 25. The delivery valve 27 discharges fuel, which is compressed in the compression chamber 22, to the common rail 1.

A cam ring 29 is installed to an outer peripheral part of an eccentric cam 28 of the cam shaft 16. The plunger 25 is urged against the cam ring 29 by a spring 30. When the cam shaft 16 is rotated, the plunger 25 is reciprocated due to eccentric movement of the cam ring 29.

When the plunger 25 moves downward to reduce the pressure of the compression chamber 22, the delivery valve 27 is closed, and the inlet valve 26 is opened. Thus, the fuel, which is metered through the inlet metering valve 14, is supplied to the compression chamber 22.

When the plunger 25 is moved upward to increase the pressure of the compression chamber 22, the intake valve 26 is closed. Then, when the pressure of the fuel, which is pressurized in the compression chamber 22, reaches the predetermined pressure, the delivery valve 27 is opened, so that the high pressure fuel, which is pressurized in the compression chamber 22, is supplied to the common rail 1 through the pump pipeline 6.

The ECU, which is provided in the control device 4, is a computer unit that includes a CPU for performing control operations and computing operations and a storage device (a memory, such as a ROM, a standby RAM, an EEPROM, a RAM) for storing various programs and data. Based on the supplied sensor signals (engine parameters indicating the operational state of the vehicle, the operational state of the engine and the like), the ECU performs various computing operations (e.g., a computing operation for computing injection timing of each injector 2, a computing operation for controlling a degree of opening of the pressure-reducing valve 11, a computing operation for controlling a degree of opening of the inlet metering valve 14).

One more specific exemplary computing operation will be briefly described. The ECU determines a target fuel injection quantity of each cylinder, an injection pattern of each cylinder and valve opening timing of the injector 2 at the time of each fuel injection based on the corresponding program stored in the ROM and also based on sensor signals (the operational state of the vehicle), which have been stored in the RAM.

The EDU, which is provided in the control device 4, is a drive circuit that provides a valve opening control value to the solenoid valve of the injector 2 based on an injector valve opening signal supplied from the ECU. When the valve opening control value is supplied to the solenoid valve of the injector 2, high pressure fuel is injected from the injector 2 into the corresponding cylinder. When the valve opening electric current is turned off, the fuel injection from the injector 2 is stopped.

A rail pressure sensor 31, an accelerator sensor 32, an engine speed sensor 33, a coolant temperature sensor 34, an intake air temperature sensor 35 and other sensor(s) 36 serve as a vehicle operational state sensing means for sensing the operational sate of the vehicle and are connected to the ECU of the control device 4. The rail pressure sensor 31 measures the rail pressure. The accelerator sensor 32 measures a degree of opening of an accelerator (e.g., a pedal position of an accelerator pedal). The engine speed sensor 33 measures an engine speed of the engine. The coolant temperature sensor 34 measures the temperature of the coolant of the engine. The intake air temperature sensor 35 measures the temperature of the intake air, which is drawn into the engine.

Next, variation learning control (learning control of the inlet metering valve 14 that controls an intake rate of fuel drawn into the high pressure pump 15) of the supply pump 3 will be described.

The control device 4 adjusts the degree of opening of the inlet metering valve 14 to control the discharge rate of the high pressure pump 15 and thereby to control the rail pressure. More specifically, the control device 4 computes a target rail pressure, which corresponds to the operational state of the vehicle. Then, the control device 4 computes a target degree of opening of the inlet metering valve 14, which achieves the target rail pressure. Thereafter, the control device 4 supplies a metering valve control value, which corresponds to the target degree of opening of the inlet metering valve 14, to the inlet metering valve 14.

Thus, the discharge rate of the high pressure pump 15 relative to a given inlet metering valve control value, which is supplied from the control device 4 to the inlet metering valve 14, should coincide with a predetermined pump characteristic (i.e., the predetermined characteristic line that indicates the relationship between the discharge rate of the high pressure pump 15 and the inlet metering valve control value to be supplied to the inlet metering valve 14). However, the actual discharge rate of fuel, which is actually discharged from the high pressure pump 15, can possibly vary relative to the inlet metering valve control value due to various factors, such as manufacturing variations and aging variations of the mass produced inlet metering valves 14, and/or variations in the temperature characteristics of, for example, a fuel viscosity or a coil attractive force.

Figure 4:
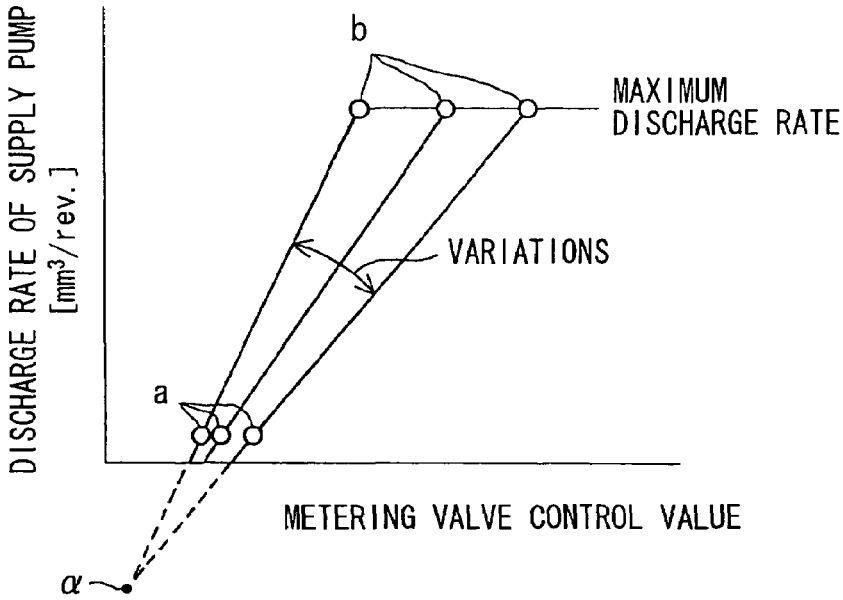
FIG. 4 is a graph showing a relationship between a discharge rate of the supply pump (i.e., a quantity of fuel discharged from the supply pump per rotation of the supply pump) and a metering valve control value for describing variations in a pump characteristic.

To address the above disadvantage, the following learning control operation has been proposed. That is, at the time of operating the engine, when a predetermined learning condition is satisfied, e.g., when the engine is in an idling state, the degree of opening of the inlet metering valve 14 is progressively increased from a prefixed value, at which a zero intake rate of the inlet metering valve 14 is guaranteed. At the time of progressively increasing the degree of opening of the inlet metering valve 14 from this value, when the amount of the change in the rail pressure becomes equal to or greater than a predetermined value, the current metering valve control value, which is currently supplied to the inlet metering valve 14, is obtained as an intake initiation control value "a" (FIG. 4). Then, this value (the intake initiation control value "a") is learned as a metering valve control value, at which the high pressure pump 15 begins the intake of fuel. In this way, variations in the small discharge rate range of the high pressure pump 15 (the small degree of opening of the inlet metering valve 14) is corrected.

The inlet metering valve 14 is the opening cross sectional area variable valve, which varies its fuel passage opening cross sectional area. Accurate control of the passage opening cross sectional area of the inlet metering valve 14 between the small degree of opening and a large degree of opening is required. However, the above learning control operation is intended to perform learning and correction of only the small degree of opening of the inlet metering valve 14 (a low discharge rate range of the high pressure pump 15). Thus, the above described variations in the large degree of opening of the inlet metering valve 14 (a high discharge rate range of the high pressure pump 15) cannot be corrected.

Thus, in the control device 4 of the present embodiment, the metering valve control value (the intake initiation control value "a"), at which the high pressure pump 15 begins intake of fuel, is computed using the above described technique. Also, in the control device 4, a maximum discharge rate control value "b" (FIG. 4), which is a metering valve control value, at which the high pressure pump 15 reaches its maximum discharge rate (the maximum performance), is computed according to a technique of the present invention. Then, in the control device 4, the pump characteristic of the high pressure pump 15 is computed based on the intake initiation control value "a" and the maximum discharge rate control value "b". Here, the pump characteristic is the characteristic that connects between "a" and "b" in FIG. 4, more specifically the characteristic line that indicates the relationship between the discharge rate of the high pressure pump 15 and the inlet metering valve control value to be supplied to the inlet metering valve 14 in a range between "a" and "b" in FIG. 4. Thereafter, in the control device 4, the metering valve control value to be supplied to the inlet metering valve 14 is computed based on the computed pump characteristic and also the computed degree of opening of the inlet metering valve 14, which is computed based on the operational state of the vehicle.

Now, the way of obtaining the maximum discharge rate control value "b" will be described in greater detail.

At the time of operating the engine, when the predetermined learning condition is satisfied (e.g., when the engine speed is stable in, for example, the idling state, and the pressure of the common rail 1 is constant), the control device 4 controls the metering valve control value to be supplied to the inlet metering valve 14 in the following manner. That is, the degree of opening of the inlet metering valve 14 is progressively increased from a preset value (a first present value) that is smaller than a maximum discharge rate implementing threshold value (a maximum performance implementing threshold value). Here, the maximum discharge rate implementing threshold value is defined as a threshold value for implementing the maximum discharge rate (the maximum performance) of the high pressure pump 15. More specifically, when the degree of opening of the inlet metering valve 14 is equal to or greater than the maximum discharge rate implementing threshold value, the maximum discharge rate of the high pressure pump 15 is achieved. At the time of increasing the degree of opening of the inlet metering valve 14, when the amount of change in the discharge rate of the high pressure pump 15 becomes equal to or less than a corresponding predetermined value, the current metering valve control value, which is currently supplied from the control device 4 to the inlet metering valve 14, is obtained as the maximum discharge rate control value (a maximum control value) "b".

Then, the pump characteristic of the high pressure pump 15 is obtained based on the maximum discharge rate control value "b" and the intake initiation control value "a" obtained using the above described technique. Based on this pump characteristic, the metering valve control value to be supplied to the inlet metering valve 14 is controlled or adjusted.

Figure 5:
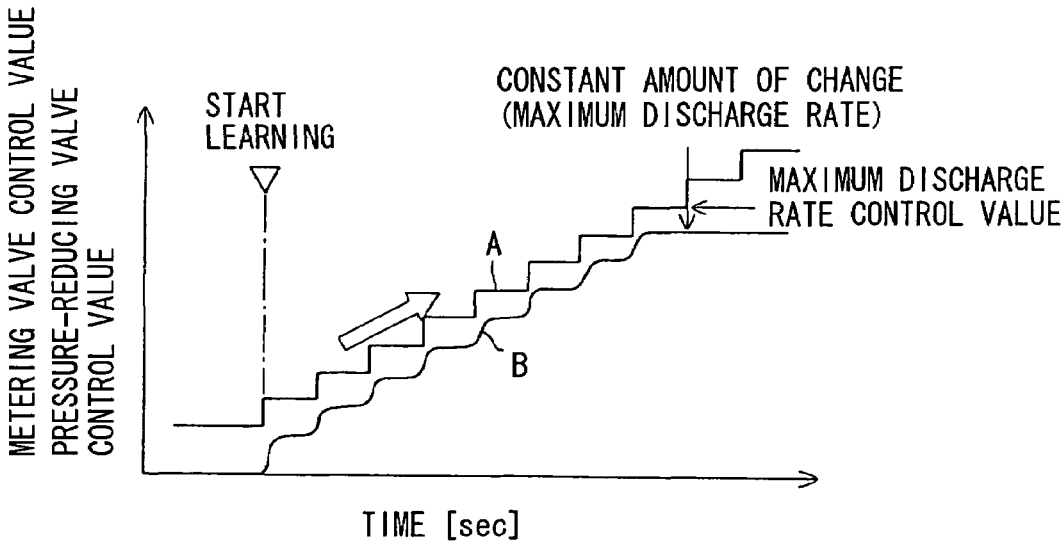
FIG. 5 is a time chart showing a feedback control of the pressure-reducing valve control value by increasing the metering valve control value using a normally closed type inlet metering valve according to the first embodiment.

In the present embodiment, a discharge rate change sensing means (or a flow rate change sensing means) for sensing the amount of change in the discharge rate of the high pressure pump 15 is implemented by a corresponding feedback control shown in FIG. 5. In the feedback control, as indicated by a solid line A in FIG. 5, the metering valve control value is progressively increased to progressively increase the degree of opening of the inlet metering valve 14, so that the discharge rate of the high pressure pump 15 is also progressively increased. During this operation, the control device 4 progressively increases the pressure-reducing valve control value, as indicated by a solid line B in FIG. 5, to progressively increase the degree of opening of the pressure-reducing valve 11 and thereby to maintain a constant pressure in the common rail 1. When the maximum discharge rate of the high pressure pump 15 is reached, the pressure of the common rail 1 does not increase further, so that the degree of opening (the pressure-reducing valve control value in the feedback control) of the pressure-reducing valve 11 is not changed further or is changed only by a small amount. Based on this fact, when the amount of change in the pressure-reducing valve control value becomes equal to or less than a predetermined value, the control device 4 senses, i.e., determines that the high pressure pump 15 has reached the maximum discharge rate.

In the present embodiment, the amount of change in the discharge rate of the high pressure pump 15 is determined based on the amount of change in the pressure-reducing valve control value. Alternatively, the amount of change in the discharge rate of the high pressure pump 15 can be determined based on the amount of change in the rail pressure, which is sensed through the rail pressure sensor 31.

In the present embodiment, as shown in FIG. 5, at the time of progressively increasing the degree of opening of the inlet metering valve 14 in the learning operation, the degree of opening of the inlet metering valve 14 is increased by a predetermined amount and is kept constant until the amount of change in the discharge rate of the high pressure pump 15 becomes a corresponding value that corresponds to the increased degree of opening of the inlet metering valve 14. Thereafter, the degree of opening of the inlet metering valve 14 is increased by the predetermined amount once again, and the above procedure is repeated. Thus, the degree of opening of the inlet metering valve 14 is progressively increased in the stepwise manner. When the amount of change in the discharge rate of the high pressure pump 15 (the amount of change in the pressure-reducing valve control value) becomes equal to or less than the predetermined value, it is determined that the high pressure pump 15 has reached the maximum discharge rate.

Figure 6:
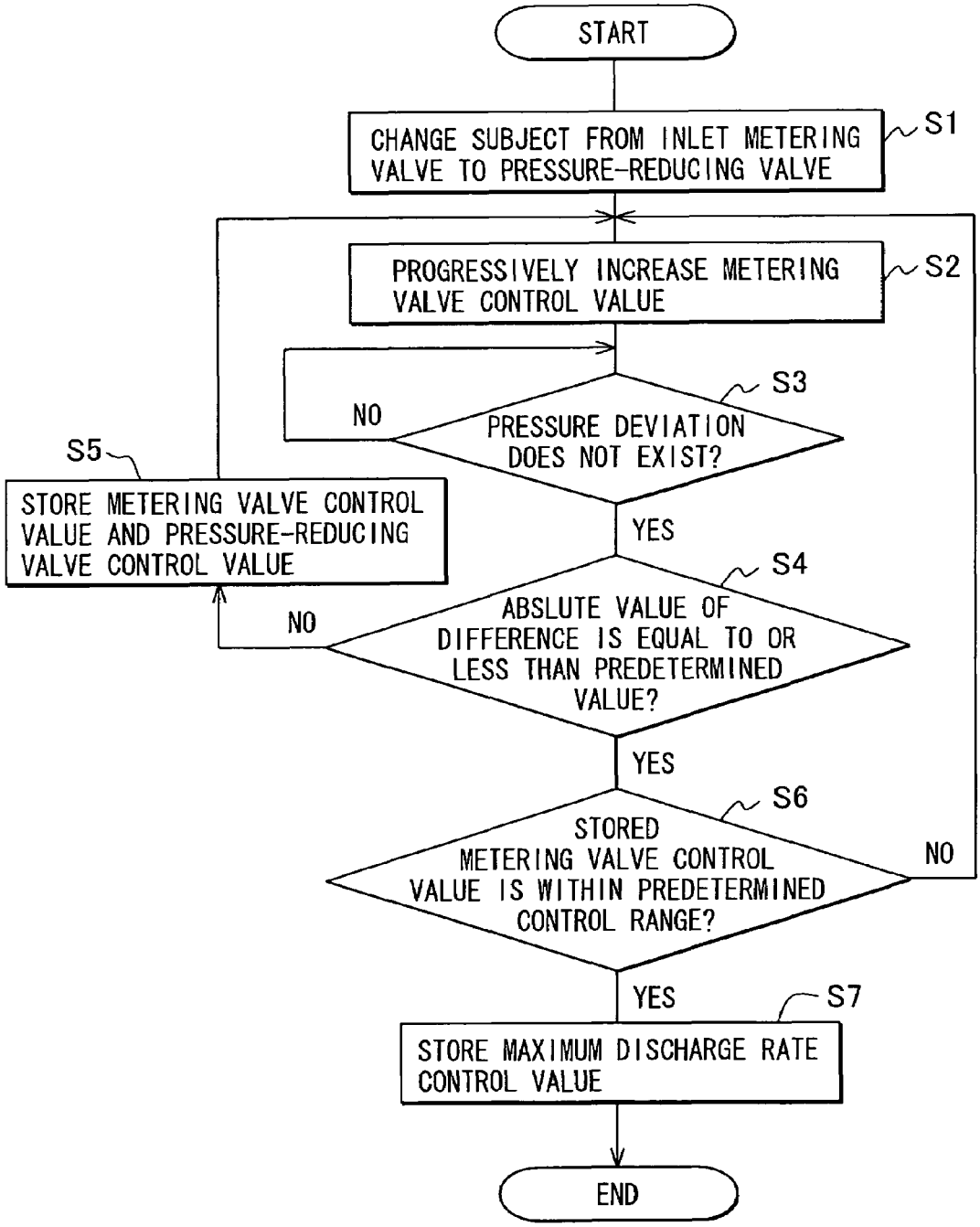
FIG. 6 is a flowchart for obtaining a maximum discharge rate control value according to the first embodiment.

The control operation for obtaining the maximum discharge rate control value "b" will now be described with reference to a flowchart of FIG. 6.

At the time of operating the engine, when the predetermined learning condition for initiating the learning operation to obtain the maximum discharge rate control value "b" is satisfied (starting the flowchart), control proceeds to step S1. At step S1, a control subject for maintaining the rail pressure at the predetermined value, which is suitable to the current operational state, is changed from the inlet metering valve 14 to the pressure-reducing valve 11. That is, during the normal operation, in order to maintain the rail pressure at the predetermined value, which is suitable to the current operational state, the degree of opening of the inlet metering valve 14 is feedback controlled in such a manner that the measured rail pressure, which is measured by the rail pressure sensor 31, coincides with the target rail pressure, which corresponds to the vehicle operational state. When the learning condition for initiating the learning operation is satisfied, the degree of opening of the pressure-reducing valve 11 is feedback controlled to maintain the pressure of the common rail 1 at a predetermined value.

Next, at step S2, the metering valve control value is increased by a predetermined amount to increase the degree of opening of the inlet metering valve 14 by a predetermined amount from the turned off state of the inlet metering valve 14, so that the discharge rate of the high pressure pump 15 is increased by a predetermined amount.

Next, at step S3, it is determined whether a pressure deviation between the computed target rail pressure and the actual rail pressure, which is measured by the rail pressure sensor 31, has become zero, i.e., does not exist (or has fallen within a predetermined pressure deviation range).

When it is determined that the pressure deviation between the computed target rail pressure and the actual rail pressure has become zero (or has fallen within the predetermined pressure deviation range) at step S3, control proceeds to step S4. At step S4, it is determined whether an absolute value of a difference between the current pressure-reducing valve control value and the previously stored pressure-reducing valve control value is equal to or less than a predetermined value. That is, it is determined whether a change in the control value of the pressure-reducing valve 11 exists.

When the answer to the inquiry at step S4 is "NO", i.e., when the change in the control value of the pressure-reducing valve 11 exists, control proceeds to step S5. At step S5, the current metering valve control value and the current pressure-reducing valve control value are stored, and control returns to step S2 to repeat the above steps.

In contrast, when the answer to the inquiry at step S4 is "YES", i.e., when the change in the control value of the pressure-reducing valve 11 no longer exists, it is determined that the discharge rate of the high pressure pump 15 has reached its maximum discharge rate, so that the maximum discharge rate control value "b" has reached. Then, at step S6, it is determined whether the stored metering valve control value is within a predetermined control range (previously determined deviation range). When the answer to the inquiry at step S6 is "NO", a storing operation for storing the maximum discharge rate control value "b" is stopped, or a guard process within the deviation range is performed, or control returns to step S2 to perform relearning of the maximum discharge rate control value "b".

When the answer to the inquiry at step S6 is "YES", the maximum discharge rate control value "b", which is obtained at the time of reaching the maximum discharge rate of the high pressure pump 15, is stored at step S7. Therefore, the learning process ends.

Next, advantages of the first embodiment will be described.

As described above, in the common rail type fuel injection system of the present embodiment, when the learning condition for obtaining the maximum discharge rate control value "b" is satisfied, the metering valve control value is progressively increased to progressively increase the degree of opening of the inlet metering valve 14, and the pressure-reducing valve control value is feedback controlled to keep the constant pressure of the common rail 1. At this time, when the high pressure pump 15 reaches its maximum discharge rate, the amount of change in the pressure-reducing valve control value becomes a constant value. When the amount of change in the pressure-reducing valve control value becomes equal to or less than the predetermined value, the control device 4 obtains the current metering valve control value as the maximum discharge rate control value "b".

Also, using the above described technique, the common rail type fuel injection system of the present embodiment obtains the intake initiation control value "a", which is the metering valve control value at the time of starting the intake of fuel by the high pressure pump 15.

Then, based on the intake initiation control value "a" and the maximum discharge rate control value "b", the pump characteristic (the characteristic that connects between "a" and "b") of the high pressure pump 15 is obtained.

The control device 4 obtains the metering valve control value to be supplied to the inlet metering valve 14 based on the pump characteristic (the characteristic that connects between "a" and "b" in FIG. 4) and the computed degree of opening of the inlet metering valve 14, which is computed based on the vehicle operational state.

Through the above described learning control operation, the deviation (the deviation between the metering valve control value and the discharge rate of the supply pump 3) can be limited in a wide range of degrees of opening of the inlet metering valve 14.

(Second Embodiment)

A second embodiment of the present invention will be described with reference to FIG. 7.

In the first embodiment, the normally closed type valve, which is fully closed upon stopping of the power supply to the valve, is used as the inlet metering valve 14. In contrast, in the second embodiment, a normally open type valve, which is fully opened upon stopping of the power supply to the valve, is used as the inlet metering valve 14.

The inlet metering valve 14 of the normally open type is fully closed when large electric current is applied to the inlet metering valve 14. Thus, at the time of progressively increasing the degree of opening of the inlet metering valve 14, the metering valve control value is progressively reduced, as shown by a dotted line A in FIG. 7.

Figure 7:
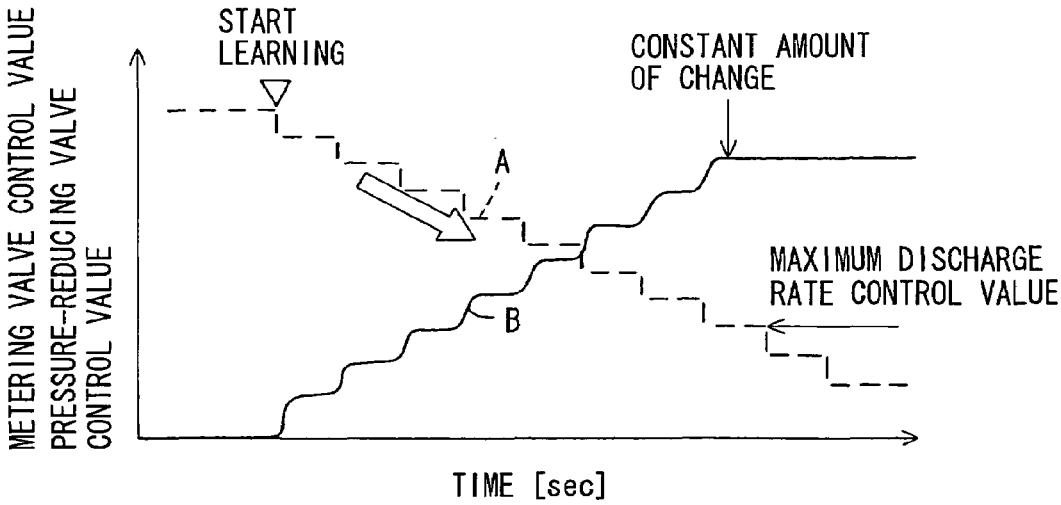
FIG. 7 is a time chart showing a feedback control of a pressure-valve control value by reducing a metering valve control value using an inlet metering valve of a normally closed type according to a second embodiment.

In the second embodiment, the discharge rate change sensing means for sensing the amount of change in the discharge rate of the high pressure pump 15 is implemented by a corresponding feedback control shown in FIG. 7. In the feedback control, as indicated by the dotted line A in FIG. 7, the metering valve control value is progressively decreased to progressively increase the degree of opening of the inlet metering valve 14, so that the discharge rate of the high pressure pump 15 is progressively increased. During this operation, the control device 4 progressively increases the pressure-reducing valve control value, as indicated by a solid line B in FIG. 7, to progressively increase the degree of opening of the pressure-reducing valve 11 and thereby to maintain a constant pressure in the common rail 1. When the maximum discharge rate of the high pressure pump 15 is reached, the pressure of the common rail 1 does not increase further, so that the degree of opening (the pressure-reducing valve control value in the feedback control) of the pressure-reducing valve 11 is not changed further or is changed only by a small amount. Based on this fact, when the amount of change in the degree of opening of the pressure-reducing valve 11 (the amount of change in the pressure-reducing valve control value) becomes equal to or less than a predetermined value, the control device 4 senses, i.e., determines that the high pressure pump 15 has reached the maximum discharge rate.

(Third Embodiment)

A third embodiment of the present invention will be described with reference to FIGS. 8 and 9.

In the first embodiment (the embodiment, in which the inlet metering valve 14 of the normally closed type is used), at the time of obtaining the maximum discharge rate control value "b", the metering valve control value is progressively increased from the state, at which the power supply to the inlet metering valve 14 is turned off. In contrast, in the third embodiment, when the learning condition for obtaining the maximum discharge rate control value "b" is satisfied, the degree of opening of the inlet metering valve 14 is progressively increased from a preset value that is smaller than and close to the maximum discharge rate implementing threshold value, which is defined as the threshold value for implementing the maximum discharge rate of the high pressure pump 15.

Figure 8:
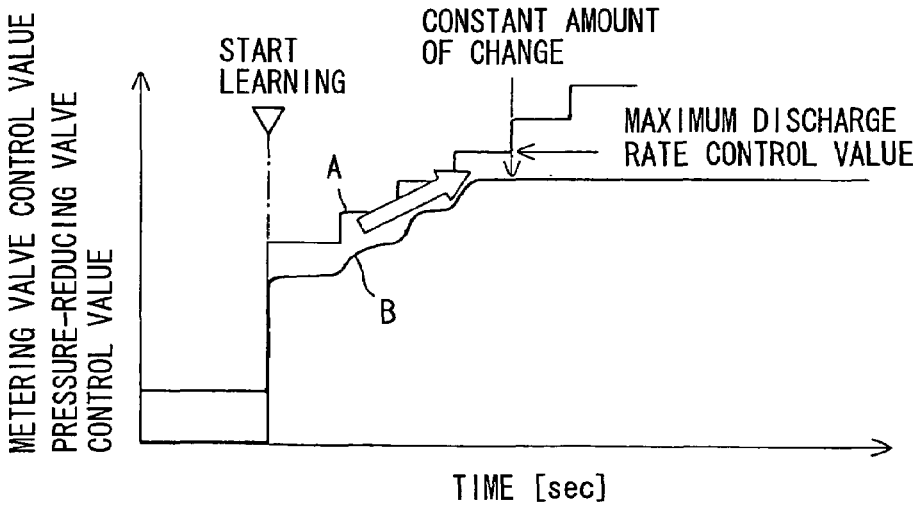
FIG. 8 is a time chart showing a feedback control of a pressure-valve control value by increasing a metering valve control value from a maximum discharge rate control value using an inlet metering valve of a normally closed type according to a third embodiment.
Figure 9:
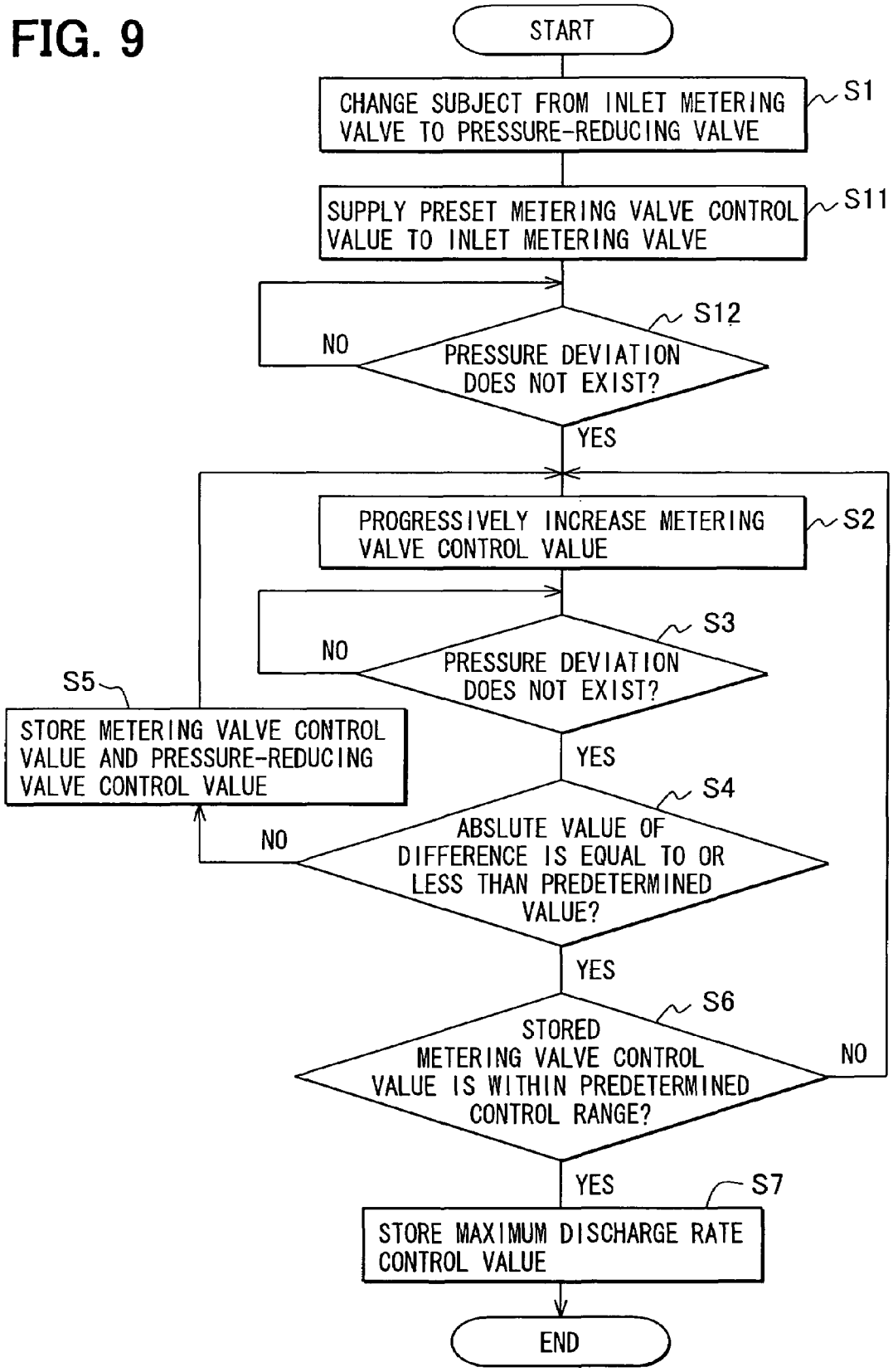
FIG. 9 is a flowchart for obtaining the maximum discharge rate control value according to the third embodiment.

More specifically, as indicated by a solid line A in FIG. 8, right after initiation of the learning operation, a predetermined metering valve control value, which is close to the maximum discharge rate implementing threshold value for implementing the maximum discharge rate of the high pressure pump 15, is supplied to the inlet metering valve 14, and thereafter the metering valve control value is progressively increased in the stepwise manner. Here, the maximum discharge rate control value "b" is obtained based on the amount of change in the pressure-reducing valve control value, which is indicated by a solid line B in FIG. 8.

The control operation of the third embodiment will be described with reference to FIG. 9.

At the time of operating the engine, when the predetermined learning condition for initiating the learning operation to obtain the maximum discharge rate control value "b" is satisfied (starting the flowchart), control proceeds to step S1. At step S1, similar to step S1 of the first embodiment, a control subject for maintaining the rail pressure to the predetermined value, which is suitable to the current operational state, is changed from the inlet metering valve 14 to the pressure-reducing valve 11.

Next, at step S11, the preset metering valve control value, which is smaller than and close to the maximum discharge rate implementing threshold value that implements the maximum discharge rate of the high pressure pump 15, is supplied to the inlet metering valve 14. Then, a pressure-reducing valve control value, which is slightly smaller than the pressure-reducing valve control value that is required to keep the predetermined pressure of the common rail 1 at the above preset metering valve control value, is supplied to the pressure-reducing valve 11.

Next, at step S12, it is determined whether a pressure deviation between the computed target rail pressure and the actual rail pressure has become zero, i.e., does not exist (or has fallen within the predetermined pressure deviation range).

When it is determined that the pressure deviation between the computed target rail pressure and the actual rail pressure has become zero (or has fallen within the predetermined pressure deviation range), control proceeds to step S2, which is described with reference to the first embodiment, and thereafter proceeds to the same steps as those of the first embodiment. Thus, details of these steps will not be described for the sake of simplicity.

As described above, the degree of opening of the inlet metering valve 14 is progressively increased from the preset metering valve control value, which is close to the maximum discharge rate implementing threshold value that implements the maximum discharge rate of the high pressure pump 15. Thus, the maximum discharge rate of the high pressure pump 15 will be reached within a short period of time upon the initiation of the learning process. Thus, the total time required to perform the learning process can be minimized.

Furthermore, in the first to third embodiments, the degree of opening of the inlet metering valve 14 is progressively increased in the stepwise manner at the predetermined intervals. Such intervals have large influence on the accuracy (accuracy of the valve position) for determining the maximum discharge rate control value "b". Thus, it is desirable to reduce or minimize the intervals to increase the accuracy of the maximum discharge rate control value "b". However, the minimization of the intervals normally results in lengthening of the learning operation.

Therefore, when the intervals are minimized, and the third embodiment is utilized, it is possible to increase the accuracy for determining the maximum discharge rate generating point of the high pressure pump 15 while minimizing the time required to perform the learning operation.

(Fourth Embodiment)

Figure 10:
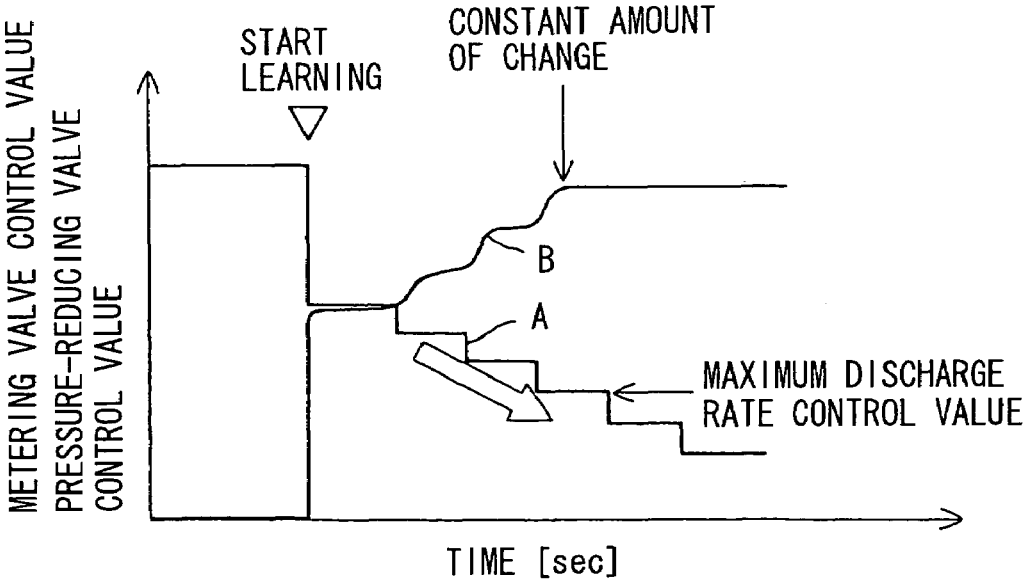
FIG. 10 is a time chart showing a feedback control of a pressure-valve control value by decreasing a metering valve control value from a value close to a maximum discharge rate control value using an inlet metering valve of a normally closed type according to a fourth embodiment.

A fourth embodiment of the present invention will be described with reference to FIG. 10.

In the third embodiment, the inlet metering valve 14 is of the normally closed type is used. Furthermore, in the third embodiment, when the learning condition for obtaining the maximum discharge rate control value "b" is satisfied, the metering valve control value is progressively increased from the preset value, which is smaller than and close to the maximum discharge rate implementing threshold value that is defined as the threshold value for implementing the maximum discharge rate of the high pressure pump 15.

In contrast, in the fourth embodiment, the inlet metering valve 14 of the normally open type is used. When the learning condition for obtaining the maximum discharge rate control value "b" is satisfied, the preset metering valve control value, which is close to and higher than the maximum discharge rate implementing threshold value that is defined as the threshold value for implementing the maximum discharge rate of the high pressure pump 15, is supplied to the inlet metering valve 14, as indicated by a solid line A in FIG. 10. Then, the metering valve control value is progressively reduced, and the maximum discharge rate control value "b" is obtained based on the amount of change in the pressure-reducing valve control value, which is indicated by a solid line B in FIG. 10.

(Fifth Embodiment)

A fifth embodiment of the present invention will be described.

In the first to fourth embodiments, the maximum discharge rate control value "b" is obtained, and the metering valve control value to be supplied to the inlet metering valve 14 is corrected through the learning operation.

In contrast, in the fifth embodiment, the control device 4 includes a learning means for correcting a variation in the pressure-reducing valve control value and a variation in the draining rate of the pressure-reducing valve 11.

The learning means controls the pressure-reducing valve control value in the following manner. That is, the degree of opening of the pressure-reducing valve 11 is progressively increased from a preset value, which is smaller than a maximum feed rate implementing threshold value that implements the maximum feed rate of fuel, which is fed from the high pressure pump 15 to the common rail 1, and the metering valve control value is controlled to maintain a constant pressure of the common rail 1 at the time of controlling the pressure-reducing valve control value. At the time of increasing the degree of opening of the pressure-reducing valve 11, when the amount of change in the feed rate of fuel, which is fed from the high pressure pump 15 to the common rail 1 and is sensed by a feed rate change sensing means, becomes equal to or less than a predetermined value, a current pressure-reducing valve control value, which is currently supplied from the control device 4 to the pressure-reducing valve 11, is obtained as a maximum draining rate control value. Thus, the learning means of the control device 4 learns that the maximum draining rate is achieved by the pressure-reducing valve 11 at the above obtained maximum draining rate control value.

The amount of change in the feed rate of fuel, which is fed from the high pressure pump 15 to the common rail 1, is determined based on at least one of the amount of change in the rail pressure measured by the rail pressure sensor 31 and the amount of change in the metering valve control value.

As discussed above, when the learning means of the control device 4 learns that the maximum draining rate is achieved by the pressure-reducing valve 11 at the above obtained maximum draining rate control value, it is possible to limit a variation in at least the large degree of opening of the pressure-reducing valve 11 (a deviation between the pressure-reducing valve control value and the draining rate). Furthermore, due to the fact that the maximum draining rate of the pressure-reducing valve 11 is achieved at the maximum draining rate control value, a draining rate characteristic relative to the degree of opening (pressure-reducing valve control value) of the pressure-reducing valve 11 may be alternatively obtained. Then, the pressure-reducing valve control value may be obtained based on the newly obtained draining rate characteristic. In this way, variations can be limited in the wide range of the degrees of opening of the pressure-reducing valve 11.

The above embodiments can be further modified as follows.

That is, in the above embodiments, the metering valve control value (the intake initiation control value "a"), at which the high pressure pump 15 begins the intake of fuel, is obtained, and also, the metering valve control value (the maximum discharge rate control value "b"), at which the high pressure pump 15 reaches its maximum discharge rate, is also obtained. Then, the pump characteristic (the characteristic between "a" and "b" in FIG. 4) of the high pressure pump 15 is obtained based on the intake initiation control value "a" and the maximum discharge rate control value "b". Alternatively, only the metering valve control value (the maximum discharge rate control value "b"), at which the high pressure pump 15 reaches its maximum discharge rate, may be obtained. Then, the pump characteristic may be obtained solely based on the maximum discharge rate control value "b".

That is, for example, an imaginary point a shown in FIG. 4 may be obtained, and the pump characteristic may be obtained by connecting the imaginary point a and the maximum discharge rate control value "b".

In the above embodiments, the inlet metering valve 14 and the pressure-reducing valve 11 are of the opening cross sectional area variable type. Alternatively, the degree of opening of the valve 14, 11 may be adjusted by adjusting a time period of opening the valve 14, 11.

In the above embodiments, the high pressure pump 15 is used as an exemplary fluid drive means for drawing or pumping fluid, and the inlet metering valve 14 and the pressure-reducing valve 14 are used as exemplary valves. Learning and correction of the variations in the inlet metering valve 14 and the pressure-reducing valve 11 are performed based on the metering valve control value or the pressure-reducing valve control value obtained at the time of attaining the maximum rate (maximum performance) of the fluid drive means. However, the fluid drive means is not limited to the high pressure pump 15 and can be any other appropriate means which can cause movement of fluid through the valve.

In the first embodiment, the learning means controls the valve control value in a manner that achieves progressively increasing of the degree of opening of the valve 14 from the first preset value, which is smaller than the maximum performance implementing threshold value that implements the maximum performance of the high pressure pump 15. At the time of progressively increasing the degree of opening of the valve 14 from the first preset value, when the amount of change in the flow rate of the fluid in the fluid passage 21, which is sensed by the flow rate change sensing means, becomes equal to or less than the corresponding predetermined value, the learning means obtains the current valve control value, which is currently supplied to the valve 14, as the maximum control value. Then, the learning means 4 learns that the high pressure pump 15 attains the maximum performance at the maximum control value. Alternatively, the learning means may control the valve control value in a manner that achieves progressively reducing of the degree of opening of the valve 14 from a second preset value, which is larger than the maximum performance implementing threshold value that implements the maximum performance of the high pressure pump 15. At the time of progressively decreasing the degree of opening of the valve 14 from the second preset value, when the amount of change in the flow rate of the fluid passage 21, which is sensed by the flow rate change sensing means, becomes equal to or greater than a corresponding predetermined value, the learning means obtains the current valve control value, which is currently supplied to the valve 14, as the maximum control value. Then, the learning means may learn that the high pressure pump 15 attains the maximum performance at the maximum control value.

Additional advantages and modifications will readily occur to those skilled in the art. The invention in its broader terms is therefore not limited to the specific details, representative apparatus, and illustrative examples shown and described.

What is claimed is:

1. A valve opening degree control system comprising:

a fluid drive means for drawing or pumping fluid;

a valve that adjusts a degree of opening of a fluid passage, which conducts the fluid drawn or pumped by the fluid drive means, wherein a maximum adjusting performance of the valve is larger than a maximum performance of the fluid drive means;

a control device that controls a degree of opening of the valve; and a flow rate change sensing means for sensing an amount of change in the flow rate of the fluid, which is conducted through the fluid passage, wherein:

the control device includes a learning means;

the learning means controls a valve control value, which is supplied to the valve to control the degree of opening of the valve;

the learning means controls the valve control value in a manner that achieves one of:

progressively increasing of the degree of opening of the valve from a first preset value, which is smaller than a maximum performance implementing threshold value that implements the maximum performance of the fluid drive means; and progressively reducing of the degree of opening of the valve from a second preset value, which is larger than the maximum performance implementing threshold value that implements the maximum performance of the fluid drive means;

at the time of progressively increasing the degree of opening of the valve from the first preset value, when the amount of change in the flow rate of the fluid in the fluid passage, which is sensed by the flow rate change sensing means, becomes equal to or less than a corresponding predetermined value, the learning means obtains the current valve control value, which is currently supplied to the valve, as a maximum control value;

at the time of progressively decreasing the degree of opening of the valve from the second preset value, when the amount of change in the flow rate of the fluid in the fluid passage, which is sensed by the flow rate change sensing means, becomes equal to or greater than a corresponding predetermined value, the learning means obtains the current valve control value, which is currently supplied to the valve, as the maximum control value; and the learning means learns that the fluid drive means attains the maximum performance at the maximum control value.

2. A common rail type fuel injection system comprising:

a common rail that accumulates high pressure fuel;

an injector that injects the high pressure fuel accumulated in the common rail;

a high pressure pump that includes a compression chamber, which draws and pressurizes fuel, wherein the high pressure pump feeds the pressurized fuel to the common rail;

an inlet metering valve that adjusts a degree of opening of a feed passage, which conducts fuel to the high pressure pump, to adjust a discharge rate of the high pressure pump, wherein a maximum feed rate of fuel, which is fed from the inlet metering valve to the high pressure pump, is greater than a maximum discharge rate of the high pressure pump;

a control device that controls at least a degree of opening of the inlet metering valve; and a discharge rate change sensing means for sensing an amount of change in the discharge rate of the high pressure pump, wherein:

the control device includes a learning means;

the learning means controls a metering valve control value, which is supplied to the inlet metering valve to control the degree of opening of the inlet metering valve;

the learning means controls the metering valve control value in a manner that progressively increases the degree of opening of the inlet metering valve from a preset value, which is smaller than a maximum discharge rate implementing threshold value that implements the maximum discharge rate of the high pressure pump;

at the time of progressively increasing the degree of opening of the inlet metering valve, when the amount of change in the discharge rate of the high pressure pump, which is sensed by the discharge rate change sensing means, becomes equal to or less than a predetermined value, the learning means obtains the current metering valve control value, which is currently supplied to the inlet metering valve, as a maximum discharge rate control value; and the learning means learns that the high pressure pump attains the maximum discharge rate at the maximum discharge rate control value.

3. The common rail type fuel injection system according to claim 2, wherein:

the learning means obtains a pump characteristic of the high pressure pump, which causes achievement of the maximum discharge rate of the high pressure pump at the maximum discharge rate control value; and the learning means determines the metering valve control value, which is supplied to the inlet metering valve, based on the pump characteristic.

4. The common rail type fuel injection system according to claim 3, wherein:

the learning means controls the metering valve control value supplied to the inlet metering valve to progressively increase the degree of opening of the inlet metering valve from a prefixed value, which guarantees a zero intake rate of the inlet metering valve;

at the time of increasing the degree of opening of the inlet metering valve from the value, which guarantees the zero intake rate of the inlet metering valve, when an amount of change in a pressure of the common rail becomes equal to or greater than a predetermined value, the learning means obtains the current metering valve control value, which is currently supplied to the intake metering valve, as an intake initiation control value;

the learning means obtains the pump characteristic of the high pressure pump, which causes achievement of the maximum discharge rate of the high pressure pump at the maximum discharge rate control value, and which also causes initiation of intake of fuel by the high pressure pump at the intake initiation control value; and the learning means determines the metering valve control value, which is supplied to the inlet metering valve, based on the pump characteristic.

5. The common rail type fuel injection system according to claim 2, further comprising:

a rail pressure sensor that senses the pressure of fuel accumulated in the common rail; and a pressure-reducing valve that adjusts a degree of opening of a drain passage, through which the fuel accumulated in the common rail is drained, wherein:

the control device also controls a degree of opening of the pressure-reducing valve;

the discharge rate change sensing means senses the amount of change in the discharge rate of the high pressure pump based on at least one of:

an amount of change in the pressure sensed by the rail pressure sensor; and a pressure-reducing valve control value, which is supplied from the control device to the pressure-reducing valve to maintain a constant pressure in the common rail by the pressure-reducing valve.

6. The common rail type fuel injection system according to claim 5, wherein:

the learning means increases the degree of opening of the inlet metering valve by a predetermined amount; and when the amount of change in the discharge rate of the high pressure pump is increased to a value, which corresponds to the increased degree of opening of the inlet metering valve, the learning means repeats the increasing of the degree of opening of the inlet metering valve by the predetermined amount to sense a time point, at which the amount of change in the discharge rate of the high pressure pump becomes equal to or less than a predetermined value.

7. The common rail type fuel injection system according to claim 2, wherein when a predetermined learning condition is satisfied, the learning means progressively increases the degree of opening of the inlet metering valve from the preset value, which is smaller than and close to the maximum discharge rate implementing threshold value that implements the maximum discharge rate of the high pressure pump.

8. The common rail type fuel injection system according to claim 2, wherein the inlet metering valve is of an opening cross sectional area variable type, which adjusts a passage opening cross sectional area in the feed passage, which conducts the fuel to the high pressure pump.

9. A common rail type fuel injection system comprising:

a common rail that accumulates high pressure fuel;

an injector that injects the high pressure fuel accumulated in the common rail;

a high pressure pump that includes a compression chamber, which draws and pressurizes fuel, wherein the high pressure pump feeds the pressurized fuel to the common rail;

an inlet metering valve that adjusts a degree of opening of a feed passage, which conducts fuel to the high pressure pump;

a pressure-reducing valve that adjusts a degree of opening of a drain passage, through which the fuel accumulated in the common rail is drained, wherein a maximum draining rate of the pressure-reducing valve for draining the fuel accumulated in the common rail is greater than a maximum feed rate of fuel, which is fed from the high pressure pump to the common rail;

a control device that controls at least a degree of opening of the inlet metering valve and a degree of opening of the pressure-reducing valve; and a feed rate change sensing means for sensing an amount of change in the feed rate of fuel, which is fed from the high pressure pump to the common rail, wherein:

the control device includes a learning means;

the learning means controls a pressure-reducing valve control value, which is supplied to the pressure-reducing valve to control the degree of opening of the pressure-reducing valve, wherein the learning means controls the pressure-reducing valve control value in a manner that progressively increases the degree of opening of the pressure-reducing valve from a preset value, which is smaller than a maximum feed rate implementing threshold value that implements the maximum feed rate of the fuel, which is fed from the high pressure pump to the common rail;

the learning means also controls a metering valve control value, which is supplied to the inlet metering valve to control the degree of opening of the inlet metering valve, wherein the learning means controls the metering valve control value in a manner that maintains a constant pressure in the common rail at the time of controlling the pressure-reducing valve control value;

at the time of progressively increasing the degree of opening of the pressure-reducing valve, when the amount of change in the feed rate of the fuel, which is fed from the high pressure pump to the common rail, becomes equal to or less than a predetermined value, the learning means obtains the current pressure-reducing valve control value, which is currently supplied to the pressure-reducing valve, as a maximum draining rate control value; and the learning means learns that the pressure-reducing valve attains the maximum draining rate at the maximum draining rate control value.

* * * * *